US007128101B2

(12) United States Patent
Cantacuzene

(10) Patent No.: US 7,128,101 B2
(45) Date of Patent: Oct. 31, 2006

(54) GAS SUPPLY DEVICE COMPRISING A PORTABLE CONTAINER AND A RECHARGING BASE

(75) Inventor: Serban Cantacuzene, Massy (FR)

(73) Assignee: L'Air Liquide, Societe Anonyme a Directoire et Conseil de Surveillance Pour L'Etude et L'Exploitation des Procedes Georges Claude, Paris (FR)

( * ) Notice: Subject to any disclaimer, the term of this patent is extended or adjusted under 35 U.S.C. 154(b) by 192 days.

(21) Appl. No.: 10/511,351

(22) PCT Filed: Apr. 7, 2003

(86) PCT No.: PCT/FR03/01089

§ 371 (c)(1),
(2), (4) Date: Oct. 12, 2004

(87) PCT Pub. No.: WO03/087651

PCT Pub. Date: Oct. 23, 2003

(65) Prior Publication Data

US 2005/0126654 A1 Jun. 16, 2005

(30) Foreign Application Priority Data

Apr. 12, 2002 (FR) ..... 02 04610

(51) Int. Cl.
*B65B 1/04* (2006.01)

(52) U.S. Cl. ..... 141/94

(58) Field of Classification Search ..... 141/2, 141/18, 98, 192, 83, 94, 351
See application file for complete search history.

(56) References Cited

U.S. PATENT DOCUMENTS

| | | | | |
|---|---|---|---|---|
| 5,472,024 | A | 12/1995 | Brugerolle et al. | |
| 5,539,188 | A | 7/1996 | Fallah et al. | |
| 5,913,344 | A * | 6/1999 | Wronski et al. | 141/83 |
| 6,510,874 | B1 * | 1/2003 | Hasenkopf | 141/2 |

FOREIGN PATENT DOCUMENTS

| | | |
|---|---|---|
| EP | 0 534 876 A1 | 3/1993 |
| EP | 1 043 540 A2 | 10/2000 |
| FR | 2 685 519 A1 | 6/1993 |
| FR | 2 765 366 A1 | 12/1998 |
| GB | 2 098 758 A | 11/1982 |
| JP | 06094192 A | 4/1994 |

OTHER PUBLICATIONS

International Search Report for PCT/FR03/00845, Oct. 23, 2003.
Patent Abstracts of Japan, publication No. 06094192, publication date Apr. 5, 1995, application date May 25, 1991, application No. 03120325.

* cited by examiner

*Primary Examiner*—Steven O. Douglas
(74) *Attorney, Agent, or Firm*—Linda K. Russell

(57) ABSTRACT

Devices for filling portable gas containers and, more specifically, devices to facilitate usage of portable gas cylinders in accordance with the safety criteria for a wide range of gases and commercial applications. The present invention provides a gas supply device to fill a portable container with an electronic label attached. The gas supply device includes a read device, and a control unit. When the portable container is connected to the device and to a gas source, the read device reads the electronic label, thus allowing a control unit to then control the supply of gas to the portable container based on the information encoded by radio frequency induction in the electronic label.

24 Claims, 2 Drawing Sheets

GAS SUPPLY DEVICE COMPRISING A PORTABLE CONTAINER AND A RECHARGING BASE

BACKGROUND

The present invention relates to a gas supply device comprising a portable container that can be coupled to a recharging base for filling purposes, said base itself being able to be connected to a gas source and including an area for receiving the portable container.

A device of this type is described in document U.S. Pat. No. 5,472,024 in the name of the Applicant.

The operational implementation of devices of this type, in particular in welding/cutting applications, has encountered problems connected with monitoring their use, especially in terms of compliance with the safety criteria relating to pressurized gas receptacles imposed by the local standards and/or by the industrial gas providers.

The assignment of electronic labels to "traditional" gas cylinders that cannot be recharged in situ has been proposed for some time now [see, for example, documents JP-A-06-094192 (Hitachi Seiki) and FR-A-2 685 519 (Gemplus Card)], but for identification and/or commercial distribution of the individual cylinders at the premises of retailers or end customers.

It is an objective of the present invention to propose an improved device to facilitate usage of portable gas cylinders in accordance with the safety criteria and offer increased capabilities, both for the user and for the industrial gas supplier, for a wide range of gases and commercial applications.

SUMMARY

The present invention provides a gas supply device comprising a portable container, a base, a read device, and a control unit. The portable container includes an electronic label, and a connection. The base is fluidly connected to a gas source and to the connection on the portable container. The read device reads the electronic label when the portable container is fluidly connected to the base. A control unit then controls the supply of gas to the portable container.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

The current invention provides a gas supply device comprising a portable container, a base, a read device, and a control unit. The portable container comprises an electronic label, and a connection for fluidly connecting the portable container to the base. The base is fluidly connected to a gas source and to the connection. A read device in the base reads the electronic label when the portable container is fluidly connected to the base. This allows a control unit to control the supply of gas to the portable container.

According to other features of the invention:

- the label and the read device are respectively arranged in the vicinity of the members for fluid connection between the container on the one hand and the base on the other hand;
- the base includes, in the low-pressure gas circuit, a solenoid valve operatively connected to the control unit.

Figure 1:
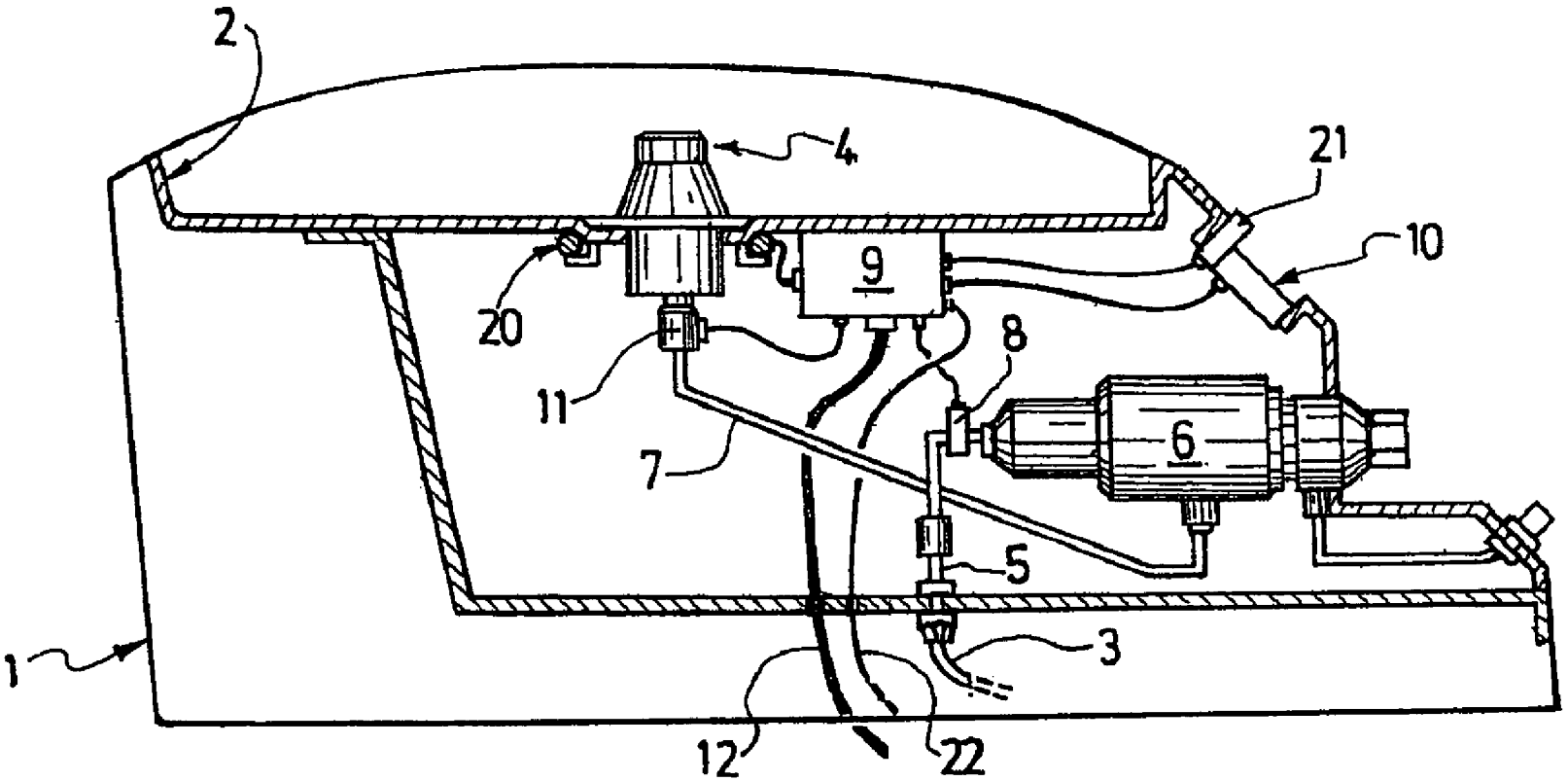
FIG. 1 is a sectional view one embodiment of a base of the present invention.

FIG. 1 shows the main elements of a recharging base according to the aforementioned document U.S. Pat. No. 5,472,024, namely, in a casing 1 including, at its top, a housing 2 tailored to receive the mobile container, gas circuitry between a feed line 3 intended to be connected to a local gas source and a profiled outlet nozzle 4 intended for connection with the cavity for filling the container, as will be seen below.

The gas circuitry includes, from upstream to downstream, a high-pressure circuit 5, a flow-regulating/pressure-reducing assembly 6, and a low-pressure circuit 7. According to one aspect of the invention, the high-pressure circuit 5 is provided with a pressure sensor 8 supplying signals which are read and stored in a control unit 9 which in turn supplies output signals to a display unit 10. The low-pressure circuit 7 is provided, downstream, with a solenoid valve 11 operatively connected to the control unit 9. The latter is supplied by a local electricity network, via a lead 12, or optionally by a rechargeable battery incorporated in the base.

Figure 2:
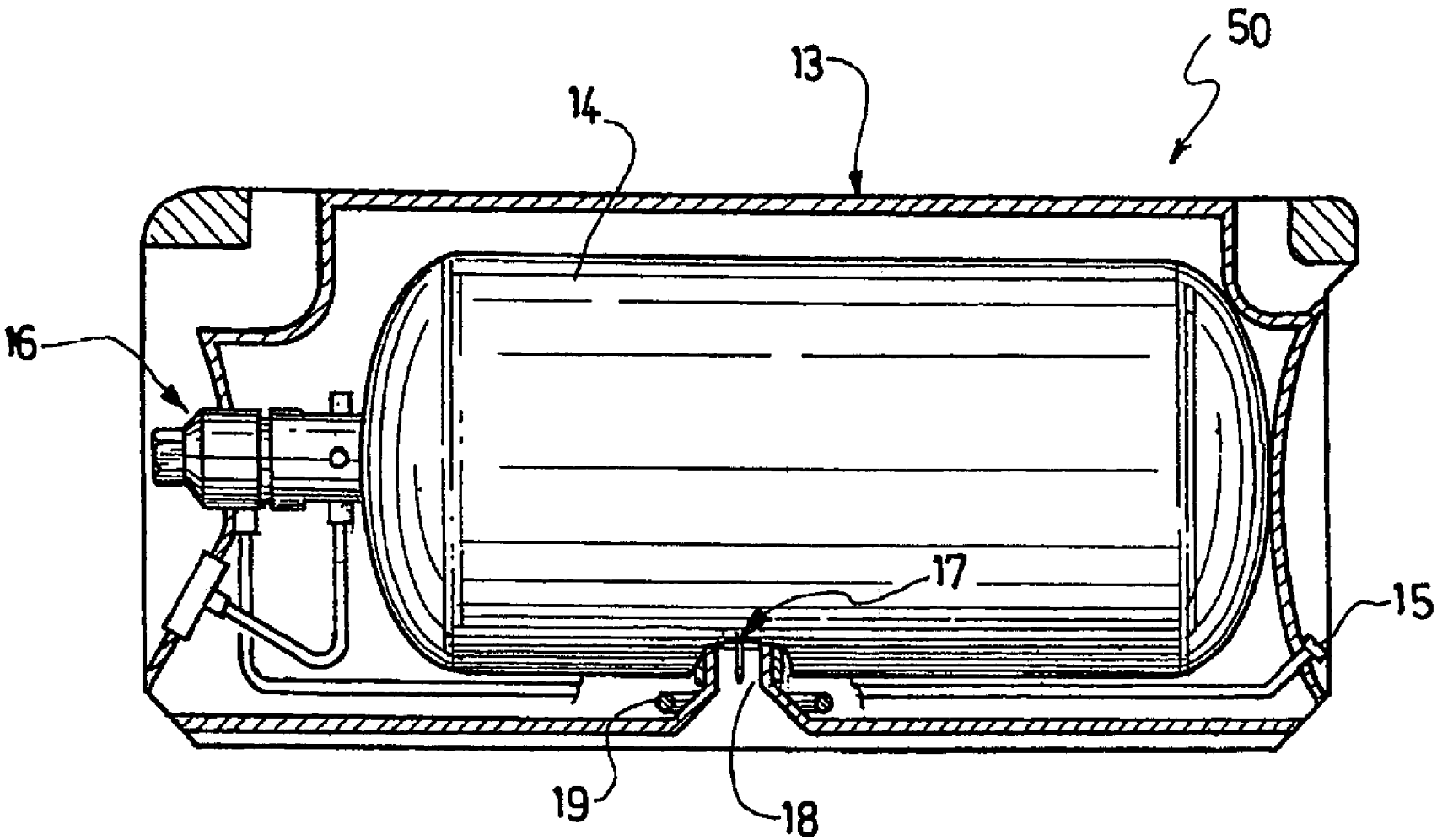
FIG. 2 is a sectional view one embodiment of a portable container of the present invention.

FIG. 2 shows the main elements of the portable container 50, essentially comprising, in a casing 13, a medium-pressure gas reservoir 14 for supplying a flow of gas controlled by a flow-regulating valve 16 to an outlet connection 15 that can be connected to a user apparatus. The reservoir 14 includes on its side an inlet connection with a valve 17 situated in the continuation of a profiled cavity 18 which is intended to receive the nozzle 4 when the container 50 is positioned in the housing 2 of the base 1.

According to a key aspect of the invention, the container 50 includes, in the vicinity of the inlet connection 17, typically around the inlet passage 18, an electronic label or "tag" 19 including at least one nonvolatile memory and an activation antenna that can be coupled by radiofrequency induction with a corresponding antenna of a radiofrequency read/write device 20 arranged in the base 20 around the nozzle 4 and connected to the control unit 9.

The device is employed in the following way:

During normal operation, the system (solenoid valve 11 (valve of the nozzle 4) for opening/closing the low-pressure circuit is normally closed. When a user places the portable container 50 on the base 1 in order to fill it, the reader 20 reads the data contained in the label 19 concerning the container 50 in question, in particular the hydraulic test or retest date, the number of filling cycles already carried out, the type of gas stored and the name of the registered user. These data are at least temporarily stored in the control unit 9 and can be transferred, via a data processing connector 21, to a portable computer or a local server, or can even be downloaded to a data processing network or a telephone network via a data transfer line 22 connected to an output of the control unit 9.

When the data of the container 50 comply with the safety criteria defined for the type of gas in question (which are imposed by the local standards and/or set by the industrial gas supplier) and if the pressure of the local gas source, measured by the sensor 8, is sufficient, the unit 9 initiates opening of the low-pressure circuit and filling of the container 50, the data of the latter being updated in the label 19 and, correspondingly, in the unit 9.

On the other hand, when the data of the container do not comply with the safety criteria for the gas in question or if the pressure of the source is not sufficient (for example less than 21 bar), the low-pressure circuit 7 remains closed and an error message is displayed on the display 10 indicating the procedure for the client to follow: send the container for maintenance (in the event that the latter needs to be tested), correctly place the container on a base delivering the appropriate gas, or replace the reservoir containing the gas source.

The data of each transaction (date, hour, user name, initial pressure, final pressure, number of cycles run by the cylinder since the last test) can be transferred, via the connector 21 or the line 22, in a standard format (for example, text file or Excel) and make it possible to produce a distribution of the gas consumption per user and also a curve showing the change of pressure in the gas source connected to the base over time. This last item of information makes it possible to anticipate the moment when the source cylinder will have to be replaced, either directly and remotely by the gas supplier or at the request of the user.

Moreover, by virtue of the pressure sensor 8 and the stored data, it is possible to signal the existence of any gas leaks to the user.

Although the invention has been described with reference to specific embodiments, it is not restricted to these but may be subject to modifications and variants which will become apparent to a person skilled in the art within the scope of the claims which follow. In particular, in a more concrete version, the gas source may itself be provided with a label identifying the type of gas that it contains and the base 1 may have a mobile read means identifying the gas source. The low-pressure circuit would not be allowed to open in this case unless the gas type identified on the label of the container properly corresponds to the gas type marked in the label of the source.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A gas supply device apparatus comprising:

a) a portable container, wherein said portable container comprises:
   i) an electronic label, and
   ii) a connection;

b) a base, wherein said base is fluidly connected to a gas source and to said connection;

c) a read device, wherein said read device reads said electronic label; and d) a control unit for controlling the supply of gas to said portable container.

2. The apparatus as claimed in claim 1, wherein said electronic label and said read device are respectively arranged in the vicinity of said fluid connection between said portable container and said base.

3. The apparatus as claimed in claim 2, wherein said electronic label is of the passive type with emulation by radiofrequency induction.

4. The apparatus as claimed in claim 3, wherein said read device comprises an antenna.

5. The apparatus as claimed in claim 4, wherein said antenna surrounds a nozzle for coupling said portable container to said base.

6. The apparatus as claimed in claim 1, wherein said base comprises a solenoid valve in a low-pressure gas circuit, and wherein said solenoid valve is controlled by said control unit.

7. The apparatus as claimed in claim 6, wherein said base further comprises a pressure sensor in a high-pressure gas circuit, wherein said pressure sensor is connected to said control unit.

8. The apparatus as claimed in claim 7, wherein said base further comprises a means for displaying data.

9. The apparatus as claimed in claim 8, wherein said control unit further comprises a means for transmitting data to an external device.

10. The apparatus as claimed in claim 1, wherein said base comprises a pressure sensor in a high-pressure gas circuit, wherein said pressure sensor is connected to said control unit.

11. The apparatus as claimed in claim 10, wherein said base includes a means for displaying data.

12. The apparatus as claimed in claim 11, wherein said base includes a means for transmitting data to an external device.

13. The apparatus as claimed in claim 10, wherein said base includes a means for transmitting data to an external device.

14. The apparatus as claimed in claim 1, wherein said base includes a means for displaying data.

15. The apparatus as claimed in claim 14, wherein said base comprises a solenoid valve in a low-pressure gas circuit, and wherein said solenoid valve is controlled by said control unit.

16. The apparatus as claimed in claim 14, wherein said base includes a means for transmitting data to an external device.

17. The apparatus as claimed in claim 1, wherein said control unit includes a means for transmitting data to an external device.

18. The apparatus as claimed in claim 17, wherein said base comprises a solenoid valve in a low-pressure gas circuit, and wherein said solenoid valve is controlled by said control unit.

19. The apparatus as claimed in claim 3, wherein said base comprises a solenoid valve in a low-pressure gas circuit, and wherein said solenoid valve is controlled by said control unit.

20. The apparatus as claimed in claim 3, wherein said base comprises a pressure sensor in a high-pressure gas circuit, wherein said pressure sensor is connected to said control unit.

21. The apparatus as claimed in claim 3, wherein said base includes a means for displaying data.

22. The apparatus as claimed in claim 3, wherein said control unit includes a means for transmitting data to an external device.

23. A gas supply device apparatus comprising:

a) a portable container, wherein said portable container comprises:
   i) an electronic label, and
   ii) a connection;

b) a base, wherein said base is fluidly connected to a gas source and to said connection;

c) a read device, wherein said read device reads said electronic label; and d) a control unit for controlling the supply of gas to said portable container, wherein said base comprises a solenoid valve in a low-pressure gas circuit and said solenoid valve is controlled by said control unit, wherein said base further comprises a pressure sensor in a high-pressure gas circuit and said pressure sensor is connected to said control unit, wherein said base further comprises a means for displaying data, and wherein said control unit further comprises an means for transmitting data to an external device.

24. A gas supply device apparatus comprising:

a) a portable container, wherein said portable container comprises:

i) an electronic label, and ii) a connection;

b) a base, wherein said base is fluidly connected to a gas source and to said connection;

c) a read device, wherein said read device reads said electronic label; and d) a control unit for controlling the supply of gas to said portable container, wherein said electronic label is of the passive type with emulation by radiofrequency induction, wherein said base comprises a solenoid valve in a low-pressure gas circuit and said solenoid valve is controlled by said control unit, wherein said base comprises a pressure sensor in a high-pressure gas circuit and said pressure sensor is connected to said control unit, wherein said base includes a means for displaying data, and wherein said control unit includes a means for transmitting data to an external device.

* * * * *